United States Patent [19]

Kamo

[11] 4,204,801

[45] May 27, 1980

[54] SEWAGE PUMP ASSEMBLY

[76] Inventor: Yohichi Kamo, 3-4-10, Gohongi, Meguro-ku, Tokyo, Japan

[21] Appl. No.: 864,815

[22] Filed: Dec. 27, 1977

[30] Foreign Application Priority Data

Dec. 29, 1976 [JP] Japan ..... 51-178155[U]

[51] Int. Cl.[2] ..... F04D 29/70; F04B 49/00

[52] U.S. Cl. ..... 415/121 G; 417/36

[58] Field of Search ..... 417/36, 40, 360; 415/121 E, 121 G

[56] References Cited

U.S. PATENT DOCUMENTS

| | | | |
|---|---|---|---|
| 2,747,513 | 5/1956 | Atkinson | 415/121 E |
| 3,233,549 | 2/1966 | Howe | 417/40 |
| 3,890,065 | 6/1975 | Eller | 417/360 |
| 3,963,376 | 6/1976 | Miskin | 417/40 |
| 3,972,647 | 8/1976 | Niedermoyer | 415/121 G |

*Primary Examiner*—William L. Freeh

*Attorney, Agent, or Firm*—Thomas R. Morrison

[57] ABSTRACT

A sewage pump assembly includes a sewage pump having an inlet port; and a substantially vertical pipe connected to the inlet port of the sewage pump, and extending up to a predetermined level relative to the sewage pump. The vertical pipe has a first inlet opening directed upwardly at its top end, and a second inlet opening extending in a predetermined length from the top end along the vertical pipe. The vertical pipe is connected through a long vertical suction pipe to the inlet port of the sewage pump. Floating materials on the filthy water can be sucked into the first and then second inlet openings of the vertical pipe for a long time required for the water level of the filthy water to change from a level slightly higher than the first inlet opening to another level adjacent to the lower end of the second inlet opening.

10 Claims, 11 Drawing Figures

SEWAGE PUMP ASSEMBLY

BACKGROUND OF THE INVENTION

1. Field of the Invention

This invention relates to a sewage pump assembly, and more particularly to a sewage pump assembly which is sunk into filthy water contained in a cesspool constructed, for example, in the lowest basement of a building, and by which the filthy water is raised to a sewer or the like.

2. Description of the Prior Art

As well known, a cesspool is constructed in the lowest basement of a building. Waste water or excreta from toilets of the building, slops from different parts of the building and the like are led into the cesspool, and they are temporarily stored there.

The sewage pump assembly is equipped with an automatic drive apparatus. When the filthy water is stored up to a predetermined level in the cesspool, the sewage pump assembly is automatically operated with the automatic drive apparatus, and the filthy water is raised up to the sewer from the cesspool.

The filthy water containing foul materials is apt to rot. The rot filthy water give out a very bad smell. When it flows through the sewer, the very bad smell is given out from a manhole in a street. That is a kind of public nuisance.

One of causes for discharging the rot filthy water is that the frequency of pumping operations is very low. However, the most important cause is that different floating materials on the filthy water such as oil, dust, mosquito, larvae and maggots increase and will facilitate the rotting of filthy water in the cesspool.

Accordingly, it is required for any sewage pump to discharge the floating materials on the filthy water as much as possible.

For such a purpose, a sewage pump assembly as shown in FIG. 1 has been disclosed by this applicant in the Japanese Utility Model Publication No. 48722/1976. Referring to FIG. 1, a long vertical suction pipe 43 is connected to an inlet port 42 of a sewage pump 41. An upper inlet opening 44 directed upwardly and positioned at a predetermined level relative to the sewage pump 41, and a lower inlet opening 45 positioned near the bottom of a cesspool 46 are connected through curved pipes to the long vertical suction pipe 43. When the pump 41 is driven, some of the floating materials and settlings are sucked through the upper and lower inlet openings 44 and 45 into the pump 41.

However, the floating materials are sucked only for a very short time before the pump 41 is stopped. The discharging amount of the floating materials is thus limited.

The sewage pump 41 is controlled with an automatic drive apparatus. When the water level of the filthy water has reached a predetermined upper limit level $L_1$ in the cesspool 46, the drive of the sewage pump 41 is automatically started by upper level control 60*a* to suck the filthy water through the upper and lower inlet openings 44 and 45 and to discharge it outwards through a discharge pipe 47. And when the water level of the filthy water has reached a predetermined lower level $L_2$, the drive of the sewage pump 41 is automatically stopped by lower level control 60*b*. The draw of the filthy water is stopped.

The pump 41 is automatically stopped at the lower limit level $L_2$ which is higher by 1 to 3 cm than the upper inlet opening 44. Thus, there is some clearance between the level of the upper inlet opening 44 and the lower limit level $L_2$. Accordingly, the pump 41 is prevented from sucking air to run idle and to waste electric power.

At the initial stage of the pumping operation when the water level of the filthy water is nearer to the predetermined upper limit level $L_1$, the floating materials on the water level cannot be sucked into the upper inlet opening 44, since the upper limit level $L_1$ is further higher than the upper inlet opening 44. The water level lowers with the pumping operation. When the water level of the filthy water has reached such a level as nearer to the lower limit level $L_2$, for example as higher by 5 to 6 cm than the upper inlet opening 44, the floating materials on the water level start to be sucked into the upper inlet opening 44. However, after that, the water level of the filthy water reaches the lower limit level $L_2$ in a short time. The sewage pump 41 stops.

The time for which the floating materials are discharged through the upper inlet opening 44 by the pump 41, is very short. The discharging amount of the floating materials such as oil is very little. Moreover, when the pump 41 is stopped, the filthy water in the discharge pipe 47 is returned through the upper and lower inlet openings 44 and 45 into the cesspool 46 with its dead load. Also the floating materials are returned into the cesspool 46 together with the filthy water. As the result, the discharging efficiency of the floating materials is reduced.

SUMMARY OF THE INVENTION

An object of this invention is to provide a sewage pump assembly by which floating materials such as oil can be surely discharged for a long time extending from the earlier stage of the pumping operation to the terminal stage of the pumping operation.

Another object of this invention is to provide a sewage pump assembly by which settlings on the bottom of a cesspool together with the floating materials can be discharged.

A further object of this invention is to provide a sewage pump assembly for which cleaning operations can be easily effected.

A still further object of this invention is to provide a sewage pump assembly in which an inlet port of the sewage pump can be prevented from being blocked by bulky materials.

A still further object of this invention is to provide a sewage pump assembly in which a motor of the pump can be prevented from overheating to burn-out, even when an automatic drive apparatus such as a level sensor for automatically driving the sewage pump assembly is out of order.

In accordance with one aspect of this invention, a sewage pump assembly includes a sewage pump having an inlet port; and a substantially vertical pipe connected to the inlet port of the sewage pump, and extending up to a predetermined level relative to the sewage pump, the vertical pipe having a first inlet opening directed upwardly at its top end, and a second inlet opening extending in a predetermined length from the top end along the vertical pipe.

The above and other objects, features and advantages of this invention, will be apparent in the following detailed description of illustrative embodiments which are to be read in connection with the accompanying drawings.

DESCRIPTION OF THE PREFERRED EMBODIMENTS

Next, a sewage pump assembly according to one embodiment of this invention, which will be used to draw up filthy water from a cesspool disposed in a basement of a building, will be described with reference to the drawings.

Figure 1:
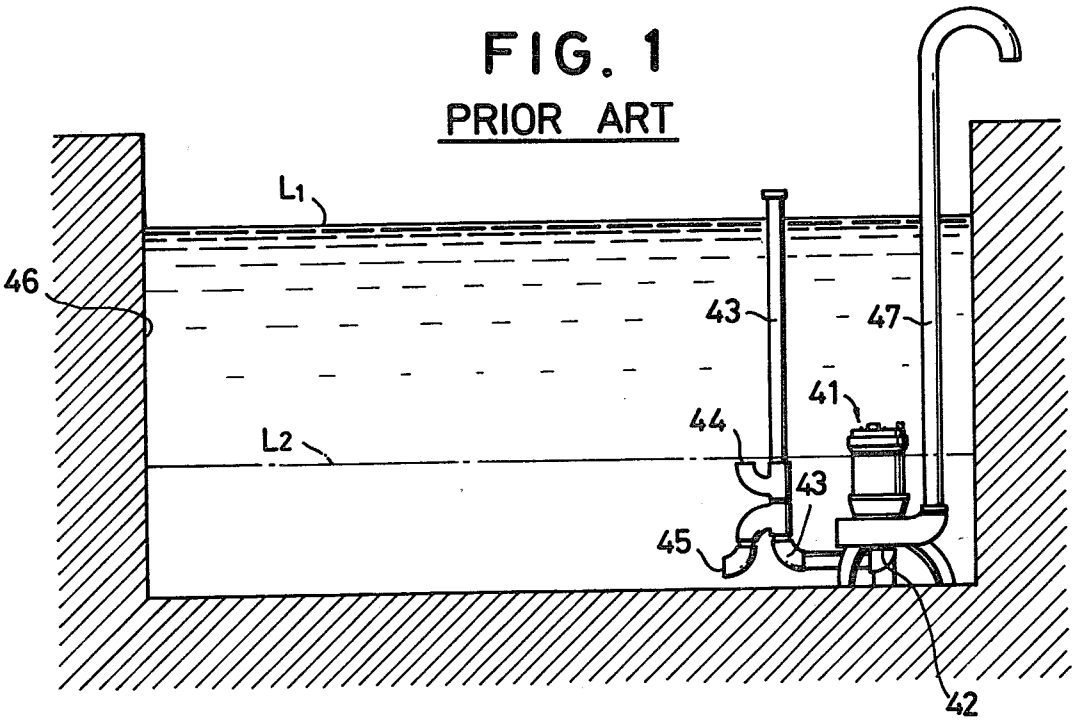
FIG. 1 PRIOR ART
FIG. 1 is a schematic view of a prior art sewage pump assembly.
Figure 2:
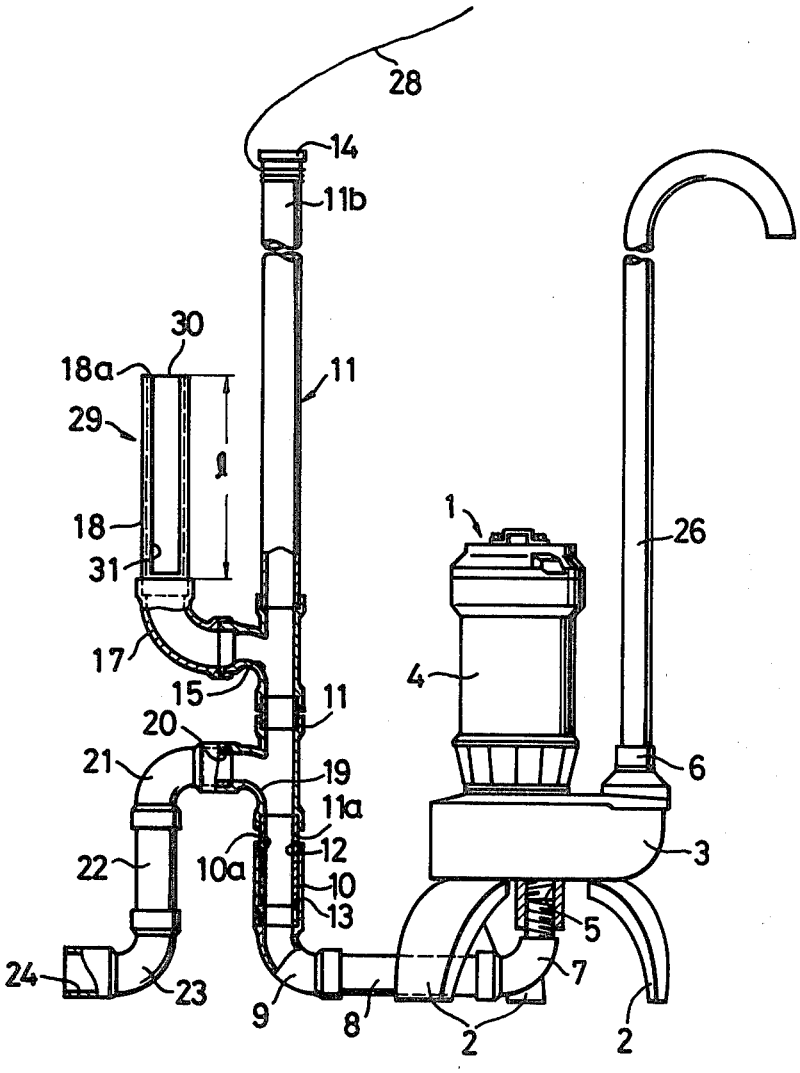
FIG. 2 is an elevational view of a sewage pump assembly according to one embodiment of this invention, partly broken away.

Referring to FIG. 2, a sewage pump 1 is constituted by a pump room 3 containing an impeller, three supporting legs 2 supporting the pump room 3, and a motor 4 vertically arranged above the pump room 3. A downwardly directed inlet port 5 is made in the center of the bottom of the pump room 3. An upwardly directed outlet port 6 is made in one end of the ceiling of the pump room 3. A lateral pipe 8 is connected through an elbow 7 to the inlet port 5 by screws. A vertical socket pipe 10 is connected through an elbow 9 to the lateral pipe 8 by screws. The vertical socket pipe 10 defines a socket 10*a*. A lower end portion 11*a* of a long suction pipe 11 is vertically and detachably inserted into the vertical socket pipe 10. In order to facilitate the insertion of the suction pipe 11 into the socket pipe 10, one end 13 of the lower end portion 11*a* of the suction pipe 11 and a top end 12 of the socket pipe 10 are tapered. The suction pipe 11 extends long and upward from the socket pipe 10. A top end 11*b* of the suction pipe 11 is covered with a cap 14. A service tee 15 is connected to the intermediate portion of the suction pipe 11, suitably distant from the socket 10*a*. An elbow 17 is connected to one end of the service tee 15. And a vertical pipe 18 is connected to the upwardly directed end of the elbow 17.

Another service tee 19 is connected to the suction pipe 11 between the one service tee 15 and the socket 10*a*. An elbow 21 is connected through a short lateral pipe 20 to the service tee 19. A vertical connection pipe 22 is connected to the downwardly directed end of the elbow 21. Further, an elbow 23 is connected to the lower end of the vertical connection pipe 22. A bottom end portion of the elbow 23 is formed as a lower inlet port 24 which is laterally directed.

Figure 4:
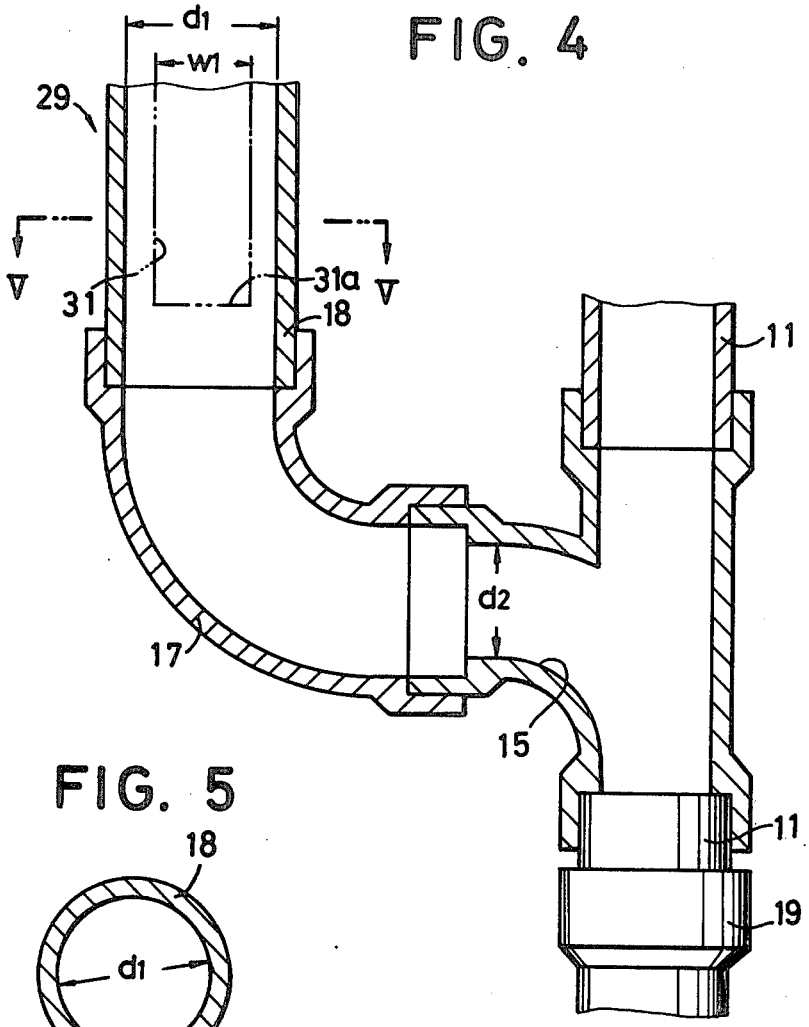
FIG. 4 is a cross-sectional view of the upper inlet port and adjacent parts of FIG. 3.
Figure 5:
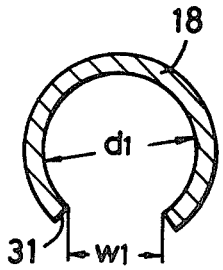
FIG. 5 is a cross-secitonal view taken along the line V—V of FIG. 4.

The vertical pipe 18 extends upwardly by a predetermined length l from the top end of the elbow 17, and it is C-shaped in cross-section, as shown in FIG. 5. An upper end 18*a* of the vertical pipe 18 functions as a first inlet opening 30. A slot 31 conjoined with the first inlet opening 30 is made in the vertical pipe 18, along the length of the latter, and it functions as a second inlet opening. A lower end 31*a* of the second inlet opening 31 (FIG. 4) is positioned at such a level as is about two third as high as the height of the pump 1, or at the higher level. The first and second inlet openings 30 and 31 constitute an upper inlet port 29. The lower lateral inlet port 24 is positioned at nearly the same level as the inlet port 5 of the pump 1, or at the lower level.

A long discharge pipe 26 is connected to the outlet port 6 of the pump 1. The pipes directly or indirectly connected to the inlet port 5 of the pump 1 may be made of synthetic resin. A rope 28 is fixed to the upper end 11*b* of the suction pipe 11. When the suction pipe 11 is inadvertently sunk down into the filthy water in the cesspool on mounting or demounting operation, the suction pipe 11 can be drawn up from the filthy water with the rope 28 extending to the exterior.

Figure 3:
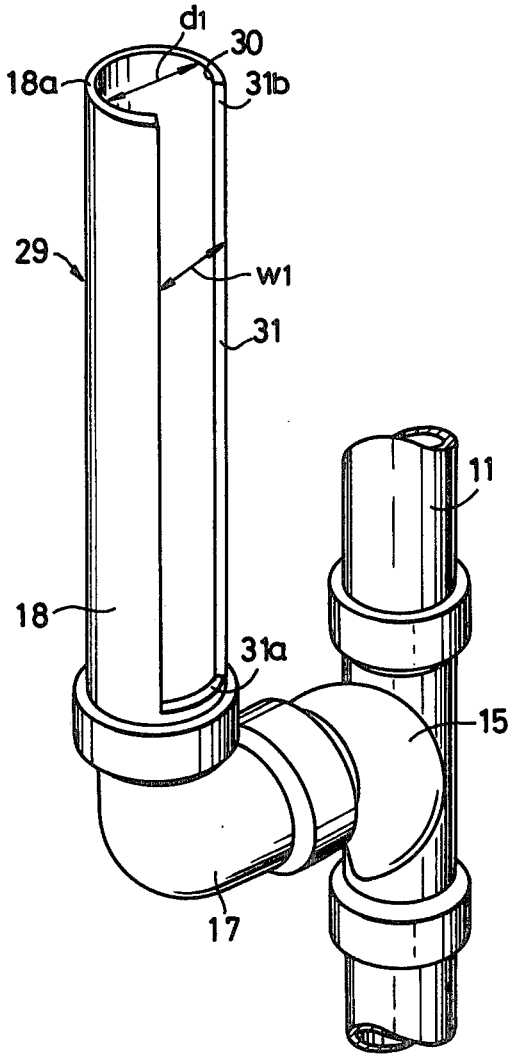
FIG. 3 is a perspective view of an upper inlet port and the adjacent parts in the sewage pump assembly of FIG. 2.

As shown in FIG. 3 to FIG. 5, the inner diameter $d_1$ of the vertical pipe 18 is so designed as to be larger than the inner diameters of the pipes succeeding to the vertical pipe 18 such as the diameter $d_2$ of the service tee 15, and the width $w_1$ of the second inlet opening 31 is so designed as to be nearly equal to, or slightly smaller than the inner diameters of the pipes succeeding to the vertical pipe 18 such as the diameter $d_2$ of the service tee 15.

Figure 6:
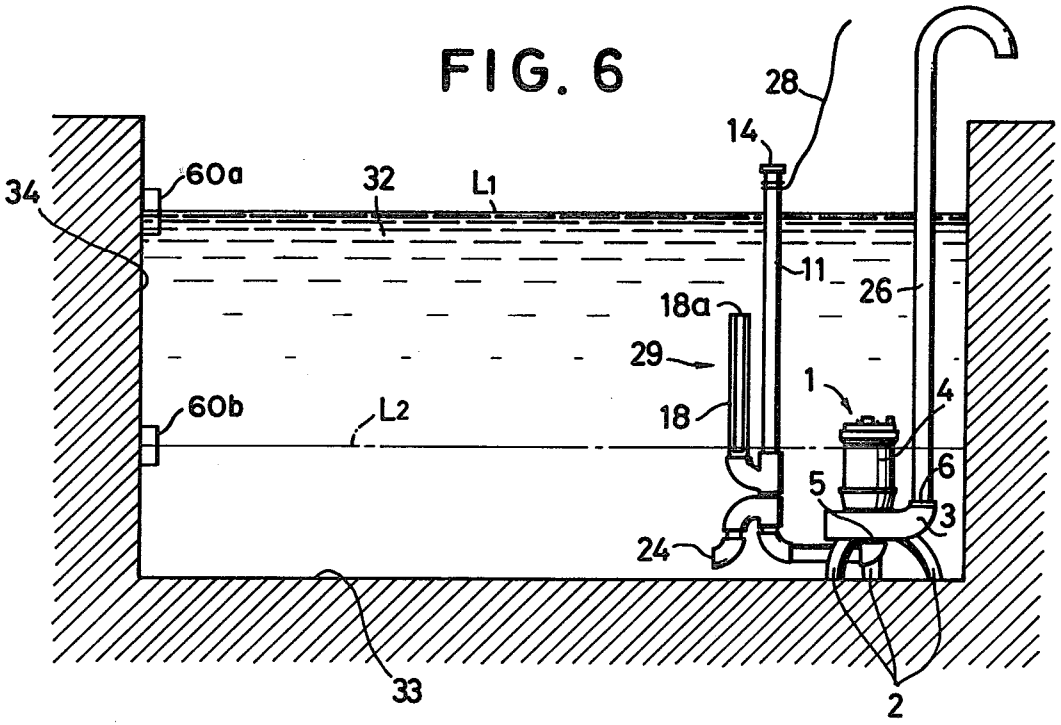
FIG. 6 is a schematic view for explanation of the use condition of the sewage pump assembly of FIG. 2.

Next, discharging operation of the sewage pump 1 will be described with reference to FIG. 6.

The sewage pump 1 is perfectly sunk down into filthy water 32 contained in a cesspool 34 which is arranged in a basement of a building.

The lower end 31*a* of the second inlet opening 31 of the upper inlet port 29 is located at such a level as lower by about 3 cm than a predetermined lower limit level $L_2$ of the filthy water 32 in the cesspool 34. The lower inlet port 24 is located near a bottom 33 of the cesspool 34. The upper end 11*b* of the suction pipe 11 is higher than a predetermined upper limit level $L_1$ of the filthy water 32 in the cesspool 34. Of course, the discharge pipe 26 is projecting from the cesspool 34, and connected to a suitable drainage installation such as a sewer.

The sewage pump 1 sunk into the filthy water 32 starts to be automatically driven. The water level of the filthy water 32 in the cesspool 34 rises with the disposal of the filthy water led from the external. When the water level of the filthy water 32 has reached the predetermined upper limit level $L_1$ in the cesspool 34, the upperlimit level $L_1$ is sensed by a not-shown level sensor to automatically drive the motor 4 of the sewage pump 1. With the drive of the pump 1, the filthy water containing various filths is sucked into the upper inlet port 29 and the lower inlet port 24, and it is introduced through the elbows 17, 23, and 21 and the service tees 15 and 19 into the suction pipe 11. Then, it is sucked through the lateral pipe 8 and the inlet port 5 into the pump room 3. It is pressurized in the pump room 3, and introduced through the outlet port 6 into the discharge pipe 26. Thus, it is discharged out of the cesspool 34.

The water level of the filthy water 32 lowers with the discharge of the filthy water. When the water level of the filthy water 32 has reached the predetermined lower limit level $L_2$ in the cesspool 34, the lower limit level $L_2$ is sensed by a not-shown level sensor to automatically stop the motor 4 of the sewage pump 1.

While the filthy water is raised out of the cesspool 34 by the sewage pump 1, settlings on the bottom 33 are surely sucked into the lower inlet port 24 to be discharged and oil or floating materials on the water surface are surely sucked into the upper inlet port 29 to be discharged.

Next, sucking operations of oil or floating materials at the upper inlet port 29 will be described with reference to FIG. 7A to FIG. 7E. The water level of the filthy water 32 lowers with pumping operation of the pump 1 in order of FIG. 7A to FIG. 7E.

Figure 7A:
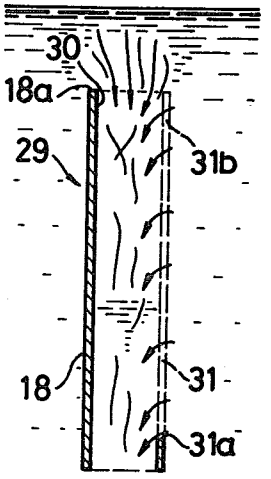
FIG. 7A to FIG. 7E are a cross-sectional view of an important part of the sewage pump assembly in which such respective situations are shown that oil, floating materials or the like is sucked into the upper inlet port together with the filthy water.

FIG. 7A shows the initial stage of the pumping operation. In this stage, the filthy water 32 is sucked both from the first inlet opening 30 and from the second inlet opening 31. As shown by arrows, the filthy water 32 is sucked through the whole circumference of the upper end of the vertical pipe 18 at the first inlet opening 30 from above, and through the almost all length of the vertical pipe 18 at the second inlet opening 31 from sides. However, at this initial stage, since the water level of the filthy water 32 is higher than the top end 18*a* of the vertical pipe 18, oil or floating materials are not yet sucked into the vertical pipe 18.

Figure 7B:
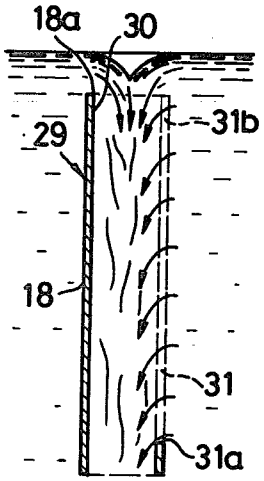

The water level of the filthy water 32 lowers with the pumping operation. FIG. 7B shows the second stage of the pumping operation. The water level of the filthy water 32 is nearer to the upper end 18*a* of the vertical pipe 18 in the stage of FIG. 7B than in the stage of FIG. 7A. Oil or floating materials on the water surface start to be sucked into the vertical pipe 18 at the upper end 18*a*. Since the upper end 18*a* of the vertical pipe 18 is positioned near the predetermined upper limit level $L_1$, the time required for the water level to change from the initial stage of FIG. 7A of the pumping operation to the second stage of FIG. 7B of the pumping operation is very short. Accordingly, in a short time after the pump 1 starts to be driven, oil or floating materials on the water surface start to be sucked into the vertical pipe 18 at the upper end 18*a*.

Figure 7C:
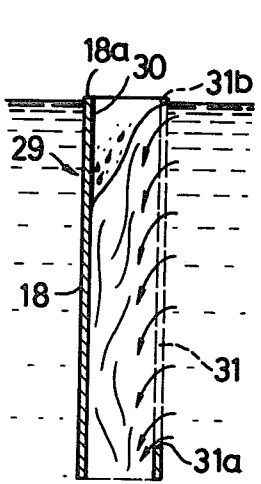

Further, the water level of the filthy water 32 lowers with the pumping operation. FIG. 7C shows the third stage of the pumping operation. In this stage, the water level of the filthy water 32 is slightly lower than the top end 18*a* of the vertical pipe 18, and so the filthy water 32 is no longer sucked through the first inlet opening 30.

The filthy water 32 is now sucked only through the second inlet opening 31 in the form of a slot, and it falls down into the vertical pipe 18 through the second inlet port 31 as a waterfall. The suction force of pump 1 acts intensively on the filthy water 32 near the lower end 31*a* of the second inlet opening 31, while it acts little on the filthy water 32 near the upper end 31*b* of the second inlet opening 31. Accordingly, the filthy water 32 near the water surface falls down into the vertical pipe 18 as waterfall in coaction of suction force with gravity.

With the fall of the filthy water 32, oil or floating materials on the water surface around the vertical pipe 18 are drawn toward the second inlet opening 31, and they fall down into the vertical pipe 18 together with the filthy water 32.

Figure 7D:
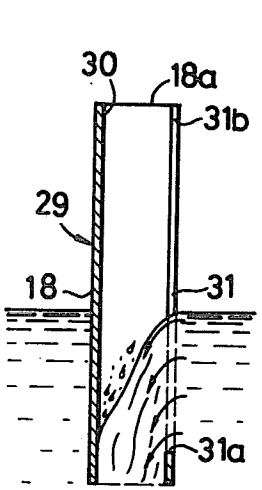

The water level further lowers. FIG. 7D shows the fourth stage of the pumping operation. The waterfall of FIG. 7C is maintained in the stage of FIG. 7D.

The above-described waterfall of the filthy water 32 is remarkably limited with the reduction of the width $w_1$ of the second inlet opening 31. The inner diameter $d_1$ of the pipe 18 having the C-shaped cross section is so designed as to be sufficiently larger than the inner diameters of the pipes succeeding to the pipe 18 such as the inner diameter $d_2$ of the service tee 15. The second inlet opening 31 is made in the pipe 18 having the larger inner diameter $d_1$. The width $w_1$ of the second inlet opening 31 is so large as to obtain surely the above-described waterfall of the filthy water 32. On the other hand, the width $w_1$ of the second inlet opening 31 is so designed as to be nearly equal to, or slightly smaller than the diameters of the pipes succeeding to the pipe 18 such as the inner diameter $d_2$ of the service tee 15. Accordingly, dust or floating materials passed through the second inlet opening 31 can be always surely sucked through the suction pipe 11 into the inlet port 5 of the pump 1.

Figure 7E:
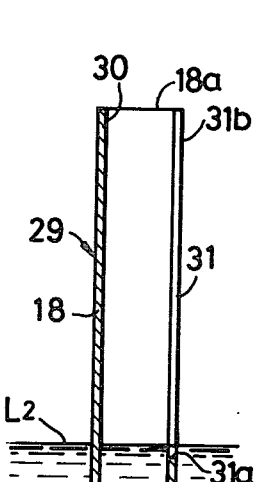

FIG. 7E shows the final stage of the pumping operation. When the water level of the filthy water 32 has reached the predetermined lower level $L_2$ which is about 3 cm higher than the lower end 31*a* of the second inlet opening 31, the pump 1 is automatically stopped. Thus, the pumping operation ends.

According to the sewage pump assembly of this invention, since oil or floating materials on the filthy water 32 can be surely discharged for the long time extending from the earlier stage of the pumping operation to the final stage of the pumping operation, the discharged amount of the oil or floating materials is very large in comparison with the conventional sewage pump assembly.

When the drive of the sewage pump 1 is stopped, the filthy water 32 containing oil or floating materials in the discharge pipe 26 is fed back through the upper and lower inlet ports 29 and 24 into the cesspool 34 with its dead load. However, since most of the oil or floating materials contained initially in the cesspool 34 are already discharged out of the discharge pipe 26, the amount of the fed-back oil or floating materials is very little, and so it is out of question.

Since the lower inlet port 24 is laterally disposed, the filthy water 32 is fed back far away along the bottom 33 from the lower inlet port 24. The large and small settlings near the lower inlet port 24 are carried far away from the lower inlet port 24 with the fed-back filthy water 32. Accordingly, when the pump 1 is next operated, the large settlings are effectively prevented from blocking the lower inlet port 24. The connecting pipe 22 may be obliquely arranged without the elbow 23 having the inlet port 24, to obtain the above-described effect.

When there is some trouble with the automatic drive apparatus such as the level sensors, it is prevented in the sewage pump assembly according to the embodiment of this invention that the motor 4 is overheated to burn-out due to an unexpected lowering of the water level of the filthy water 32. When the water level of the filthy water 32 becomes slightly lower than the predetermined lower limit level $L_2$, because of some trouble with the automatic drive apparatus, much air is sucked through the lower end 31*a* of the second inlet opening 31 into the pump 1. For that reason, the pump 1 cannot raise more filthy water 32 through the discharge pipe 26. Accordingly, it is surely prevented that the water level of the filthy water 32 in the cesspool 34 is further lowered. The pump 1 is maintained in the filthy water 32 at the predetermined depth. The motor 4 continues to be cooled by the filthy water 32, and so it cannot be overheated.

Some bulky materials which are not desired to reach the inlet port 5 of the pump 1, are intercepted or stopped at the elbows 17, 23 and 21 and the service tees 15 and 19. The elbows 17, 23 and 21 and the service tees 15 and 19 function as a kind of strainer. Some bulky materials cannot reach the inlet port 5 of the pump 1.

Operation for removing the bulky materials can be easily effected in the following manner.

The suction pipe 11 with the elbows 17, 23 and 21 and the service tees 15 and 19 is easily demounted upward from the other parts of the pump assembly, by grasping the upper end 11*b* or by pulling the rope 28, since the upper end 11*b* of the suction pipe 11 is projecting from the predetermined upper limit level $L_1$. It is not required that one person enters into the cesspool, or he dips his hands into the filthy water 32.

Since the lower end portion 11*a* of the suction pipe 11 is merely inserted into the socket pipe 10 without fixation, the suction pipe 11 can be easily drawn upward from the socket pipe 10. The elbows 17, 23 and 21, and the service tees 15 and 19 are detached from the suction pipe 11. Then, they are cleaned, and the stopped bulky materials are removed from them.

After removing the stopped bulky materials and cleaning the pipes, the lower end portion 11*a* of the suction pipe 11 is inserted into the socket 10*a* of the socket pipe 10. Since the upper end of the socket pipe 10 and the lower end of the suction pipe 11 are tapered as shown by the reference numerals 12 and 13, the suction pipe 11 can be easily inserted into the socket pipe 10, after the tapered end 13 of the suction pipe 11 is guided by the tapered end 12 of the socket pipe 10.

According to the embodiment of this invention, when the suction pipe 11 is cleaned, and the stopped bulky materials are removed from the suction pipe 11, the whole of the heavy pump assembly does not need to be taken out from the cesspool 34, but only the suction pipe 11 is drawn out upwardly. The maintainence of the pump assembly is very simple.

When the filthy water 32 needs to be perfectly discharged from the cesspool 34, for example, when the cesspool 34 is cleaned, the long suction pipe 11 is drawn out from the socket pipe 10, and the filthy water 32 is sucked from the upper end of the socket pipe 10.

According to this invention, oil, floating materials or the like can be sucked into the sewage pump for a very long time extending from the earlier stage of the pumping operation to the terminal stage of the pumping operation. Much of oil, floating materials or the like can be discharged every pumping operation.

When the sewage pump assembly according to this invention is used in the cesspool constructed in the lowest underground of a building, the filthy water in the cesspool can be prevented from early rotting. It can be avoided that the filthy water discharged into the sewer gives out the bad smell. The frequency of the pumping operations can be reduced. That is very economical.

While there has been described a preferred embodiment of the invention, obviously further modifications and variations are possible in light of the above teachings. It is therefore to be understood that within the scope of the appended claims, the invention may be practised otherwise than as specifically described.

For example, the service tee 19 is connected through the socket pipe 10 to the elbow 9 in the vertical long suction pipe 11 of the above-described embodiment. However, the service tee 19 may be directly connected to the elbow 9. Moreover, the one service tee 15 may be directly connected to the other service tee 19.

The width of the second inlet opening 31 may be changed along the length of the vertical pipe 18.

What is claimed is:

1. A sewage pump assembly comprising:
(A) a sewage pump having an inlet port;
(B) a substantially vertical pipe connected to said inlet port of the sewage pump, and extending up to a predetermined level relative to said sewage pump, said vertical pipe having a first inlet opening directed upwardly at its top end, and a second inlet opening extending a predetermined length from said top end along said vertical pipe;
(C) discharge pipe means connected to said sewage pump for discharging pumped sewage;
(D) said second inlet opening having a bottom limit which is higher than the bottom of said sewage pump;
(E) connecting means having an inner diameter between said vertical pipe and said sewage pump for connecting therebetween;
(F) said second inlet opening being a substantially vertical slot in said vertical pipe; and
(G) said pipe second inlet extending upwardly and cooperating with said first inlet to form an uninterrupted common inlet therebetween.

2. A sewage pump assembly according to claim 1, in which the cross-sectional area of said substantially vertical pipe is larger than the inner diameter of said connecting means, and the width of said slot is smaller than the inner diameter of said connecting means.

3. A sewage pump assembly according to claim 1, in which the width of said second inlet opening is large enough to effect satisfactory suction action, while the width of said second inlet opening is smaller than the inner diameters of the pipes succeeding to said vertical pipe, and smaller than the inner diameter of said vertical pipe.

4. A sewage pump assembly according to claim 1, in which a pipe having a third inlet opening is connected to said inlet port of the sewage pump, said third inlet opening being positioned at a level lower than the lower end of said second inlet opening.

5. A sewage pump assembly according to claim 4, in which said third inlet opening is directed laterally.

6. A sewage pump assembly according to claim 1 further comprising:
(a) a second pipe connected to said inlet port of the sewage pump;
(b) said second pipe having an open end at the distal end thereof; and
(c) said open end being disposed with its axis substantially horizontal and located at a level at least as low as the bottom of said sewage pump.

7. A sewage pump assembly according to claim 6, in which said vertical pipe is connected through a curved pipe to a long suction pipe which is in turn detachably inserted into a socket pipe connected to said inlet port of the sewage pump, and is closed at its upper end.

8. A sewage pump assembly according to claim 7, in which said second pipe is connected through a curved pipe to said long suction pipe which is in turn detachably inserted into said socket pipe connected to said inlet port of the sewage pump, and is closed at its upper end.

9. A sewage pump assembly according to claim 7, in which a lower end of said long suction pipe and an upper end of said socket pipe are tapered.

10. A sewage pump assembly according to claim 9, in which a rope is connected to the upper end of said long suction pipe.

* * * * *